US005720565A

United States Patent [19]

Benson

[11] Patent Number: 5,720,565

[45] Date of Patent: Feb. 24, 1998

[54] FOLDER WITH FASTENER FOR KEEPING PAPERS AND DOCUMENTS

[76] Inventor: Anders Benson, Riddargatan 17, S-114 57 Stockholm, Sweden

[21] Appl. No.: 583,547

[22] Filed: Jan. 5, 1996

[30] Foreign Application Priority Data

Jan. 11, 1995 [SE] Sweden ..... 9500075

[51] Int. Cl.[6] ..... B42F 13/06; B42F 13/08; B42F 13/10

[52] U.S. Cl. ..... 402/8; 402/15; 402/4; 402/79; 402/80 R; 402/19; 402/60

[58] Field of Search ..... 402/4, 8, 13–15, 402/18, 19, 79, 80 R, 75, 60

[56] References Cited

U.S. PATENT DOCUMENTS

| | | | |
|---|---|---|---|
| 1,094,951 | 4/1914 | Wahsburne | 402/15 |
| 1,303,279 | 5/1919 | Fisher | 402/15 |
| 1,428,172 | 9/1922 | Roy-Tracy | 402/15 |
| 1,476,088 | 12/1923 | Liddell | 402/8 X |
| 1,566,020 | 12/1925 | King | 402/15 |
| 1,636,408 | 7/1927 | Doughty et al. | 402/15 |
| 2,184,276 | 12/1939 | Brennan | 402/15 |
| 2,324,004 | 7/1943 | Kriegsman | 402/15 |
| 2,339,411 | 1/1944 | Kern | 402/15 |
| 2,352,196 | 6/1944 | Hartmann | 402/15 |
| 2,366,412 | 1/1945 | Kern | 402/15 |
| 2,380,780 | 7/1945 | Novak | 402/8 |
| 2,432,409 | 12/1947 | Gooley | 402/15 |
| 2,733,504 | 12/1956 | McGervey | 402/8 |
| 3,026,876 | 3/1962 | Peynado | 402/15 |
| 3,719,747 | 3/1973 | Grundell | 402/8 |
| 4,070,736 | 1/1978 | Land | 402/15 |
| 4,084,911 | 4/1978 | DeWitt | 402/15 |
| 4,135,832 | 1/1979 | Saltz | 402/8 X |
| 4,191,484 | 3/1980 | Zippel | 402/15 |
| 5,167,463 | 12/1992 | Corbishley | 402/8 |
| 5,257,870 | 11/1993 | Bennett et al. | 402/15 X |

FOREIGN PATENT DOCUMENTS

| | | | |
|---|---|---|---|
| 0304411 | 2/1989 | European Pat. Off. | 402/8 |
| 3625024 | 12/1987 | Germany | 402/8 |
| 922990 | 4/1963 | United Kingdom | 402/8 |

*Primary Examiner*—Frances Han

[57] ABSTRACT

The invention relates to a fastener for the resilent fillets or strips which are used to hold fast various kinds of papers in a folder or file. The fastener (10) has the shape of a bar (12) of plastics or sheet metal, at each end provided with a first notch (14) in one side of the bar and, closer to the end of the bar, a second notch (18) narrower than the first notch (14) and extending from the opposite side of the bar to form a cantilevered end portion or first tongue (15) substantially perpendicular to the longitudinal direction of the bar, whereas a longitudinal groove (22) extends from the inner end of said second notch (18) in a direction away from the end of the bar, to form a second cantilevered tongue (25). The strips (20) are inserted into the first notches (14), bent down and clamped between the tongues (15 and 25) at the ends of the bar (12) by being pushed underneath the first tongues (15) and above the second tongues (25). The invention also relates to a folder which cooperates with the fastener (10) and has strips punched from the material of the folder itself for securing the papers.

6 Claims, 3 Drawing Sheets

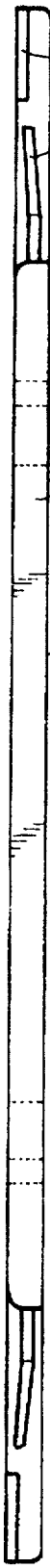
FIG. 1
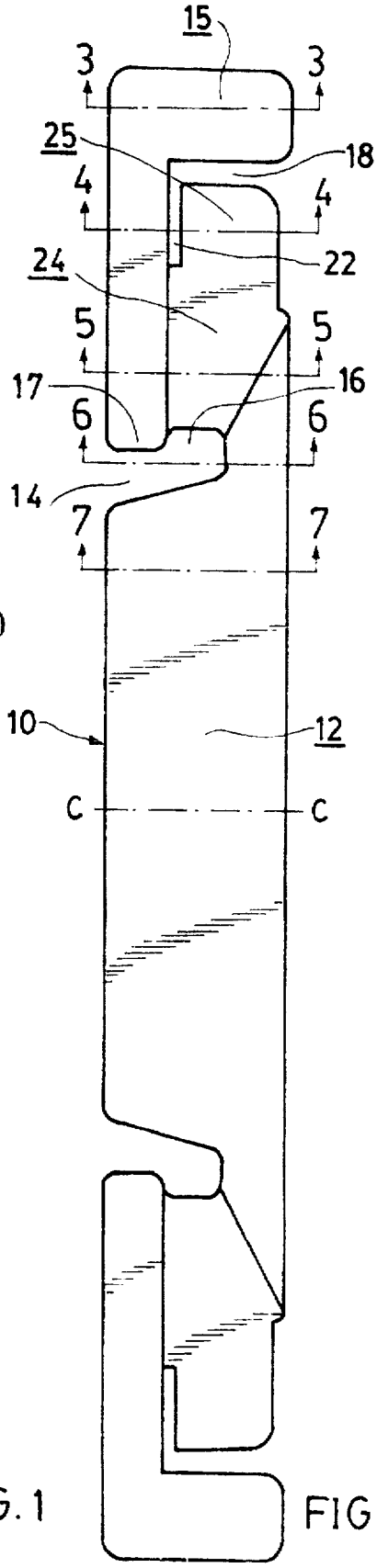
FIG. 2
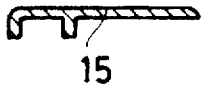
FIG. 3
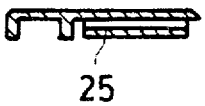
FIG. 4
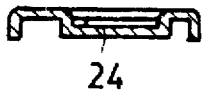
FIG. 5
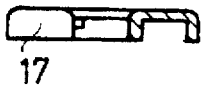
FIG. 6
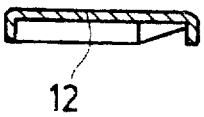
FIG. 7
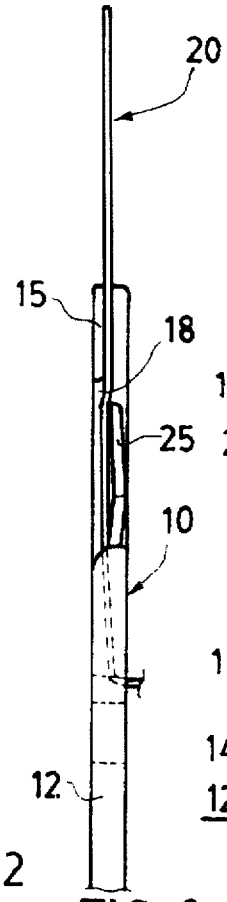
FIG. 8
FIG. 9
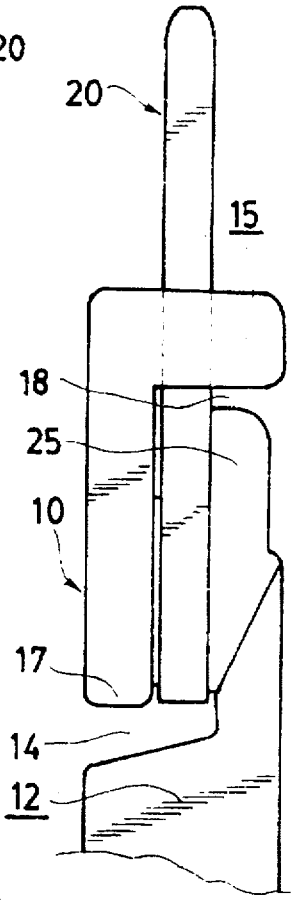

10
12
14
15
17
18
20
21
25
26
28

FOLDER WITH FASTENER FOR KEEPING PAPERS AND DOCUMENTS

The present invention relates in general to files and folders for storing all sorts of papers, such as leaflets, letters, copies and so on. The folders under consideration here are such where the paper sheets do not lie loose in the folder but are secured therein in one way or another, and in particular the invention relates to a new fastener for the securing operation.

Folders of this type are known in a multitude of configurations, but common to most of them is the fact that the papers are hold fast by means of metal strips, usually of brass, fixed in the folder. The papers concerned are then punched, i.e. they are provided, by means of the "punch" generally known in the office world, with apertures along either a long side or a short side of the papers. At least two apertures are obtained and their spacing is standardized, to 70 mm or in some countries 80 mm. The metal strips fixed in the folder are threaded through the apertures, upon which the strips are bent over and pushed against the papers. In order then to prevent the strips from pointing randomly or "straggling", fasteners of various kinds are provided, e.g. apertured bars of sheet metal, which are also threaded onto the metal strips before the strips are flattened, after which slides or socket members of plastics or metal are pushed onto the bars to hold the strips. What has now been described is a procedure known and accepted all over the world for storing papers, letters etc., and there is nothing to object thereto other than that the final manipulating when inserting the papers is somewhat cumbersome and inconvenient.

There are on the market a multitude of various fastening devices of the sort indicated and an internationally known such device is "ACCO" (trademark), indeed consisting of metal strips joined with a metal bar, secured in e.g. a folder. This bar works together with another metal bar provided with small slides for holding down the metal strips together with filed papers and documents.

The invention has for its object to provide an arrangement of this kind for storing papers in folders, primarily a generally applicable fastener for holding down said metal strips which are inserted through the papers, but the invention also relates to a specific plastic folder working with the fastener, where the material of the folder, or a plastic material associated with the folder, is utilized for making the strips which then consequently need not be made as separate units of metal. By producing folders with fasteners according to the invention great advantages are gained, in the form of lower manufacturing costs and, more important, a considerable simplification when it comes to manipulate the folder and the fastener when papers are inserted.

In conjunction of the above it should be noted that the invention need not exclusively be used as an integral part of a particular type of folder, but that the fastener of the invention can be fabricated and used used separately with and without individual folders.

The object is attained by providing the fastener according to the invention with the characteristic features defined in claim 1 and by combining the fastener with a folder as defined in claim 4.

The invention will now be disclosed and examplified in greater detail with reference to the accompanying drawings, wherein:

FIGS. 1 and 2 are side views and plan views, respectively, of the fastener according to the invention, on an enlarged scale;

FIGS. 8 and 9 are side and plan views, respectively, of an end portion of the fastener and illustrate how this interlocks with the strips holding the paper sheets;

Figure 20:
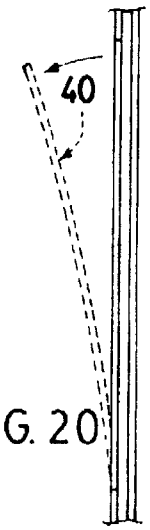
FIG. 20 is a side view of the folder area shown in FIG. 19.
Figure 21:
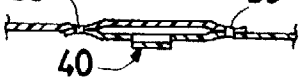
FIG. 21 shows a cross section along line 21—21 in FIG. 19.
Figures 22, 23, 24:
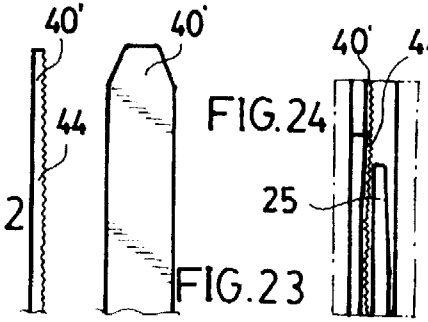

FIGS. 22 and 23 respectively show each end portion, in side and plan view, of a specifically designed plastic strip component of the folder according to FIGS. 15–21; and FIG. 24 shows the same section as FIG. 20 but with the strip shaped in accordance with FIGS. 22 and 23.

For the sake of consequence of description it is assumed according to the drawings that the fastener of the invention is adapted to hold fast the papers in a folder along their long sides, but it is understood that the papers could be hold fast along the short sides as well, more particularly along their top edges.

The fastener according to the invention is thus shown (enlarged) in FIGS. 1 and 2 and designated 10. As seen it is symmetrical (mirror symmetrical in this case) about central axis c—c and provided at its ends with gripping and engaging portions to work with and interlock with the above mentioned strips which are made separately or as an integral part of a file or folder, as will be described. The said symmetry means that the fastener 10 is shaped alike in both ends, and what is shown and disclosed about the one end portion is true for the other as well.

The fastener 10 is primarily intended for injection moulding of plastics in a comparatively simple male-female mould with several inserts. Its shape, however, is such that it can be produced quite readily by hobbing and cutting thin sheet metal. In the embodiment shown it has the shape of a thin plastic bar 12, 14–15 mm wide and about 120 mm long. On one side two open area notches 14 are provided wherein strips raised up from a folder can be pushed in laterally, as will be explained. The notches 14 reach a little more than half way into the bar, and as can be seen they have at their innermost part a short extension 16 outwards towards the ends of the bar, so that short portions 17 or "hooks", directed inwardly from the ends, are left at the edge of the bar 12, see in particular FIG. 2. These portions 17 have a laterally locking effect on the strips, as will be explained.

At each end of the fastener 10 cantilevered tongues 15 are formed, which extend from the same side as the notches 14, cantilevered towards the opposite side, see cross section FIG. 3. Each tongue 15 becomes cantilevered by a second notch 18, which in relation to said first notch 14 extends from the opposite side of the bar, this second notch 18 being considerably narrower than the first one. It reaches approximately as deep into the bar 12 from its side as the first notch 14 reaches into the bar from the opposite side, and this notch 18 is extended at its inner end by a longitudinal groove 22, which thus extends, directed away from the end of the bar, perpendicularly to the notch 18 from which it extends. Hereby there is formed a second, longitudinally directed, cantilevered tongue 25, and this merges into a portion 24 which slopes and narrows towards the first notch 14. The change of shape of the fastener along its end portions can in fact clearly be seen from the series of cross sections shown in FIGS. 3 to 7.

Now, the two cantilevered tongues 15 and 25 are quite simply adapted to work in such a way that if a strip, which in FIG. 8 and the following figures is designated 20, is inserted into the first notch 14, then bent down over portion 24 and pushed into the second notch 18, underneath the cantilevered tongue 15 and above tongue 25, likewise cantilevered, it will be clamped or pinched between the opposing edges of the tongues, because of the fact that the extensions of the top side of tongue 25 and the under side of tongue 15 are spaced so close that a clamping effect is obtained. In order to insert a strip 20 into notch 18, beneath tongue 15 and above tongue 25, one or both tongues must thus yield somewhat and thereby pinch the strip. This can clearly be seen in FIGS. 8 and 9, showing the final position of a strip 20 which has been put up through e.g. a bundle of papers, then inserted into the notch 14, bent down over portion 24 of the fastener bar 12 and pushed into notch 18 and underneath tongue 15, there to be clamped fast. The clamping area proper is shown enlarged in FIG. 13.

Figures 10, 11, 12, 13, 14:
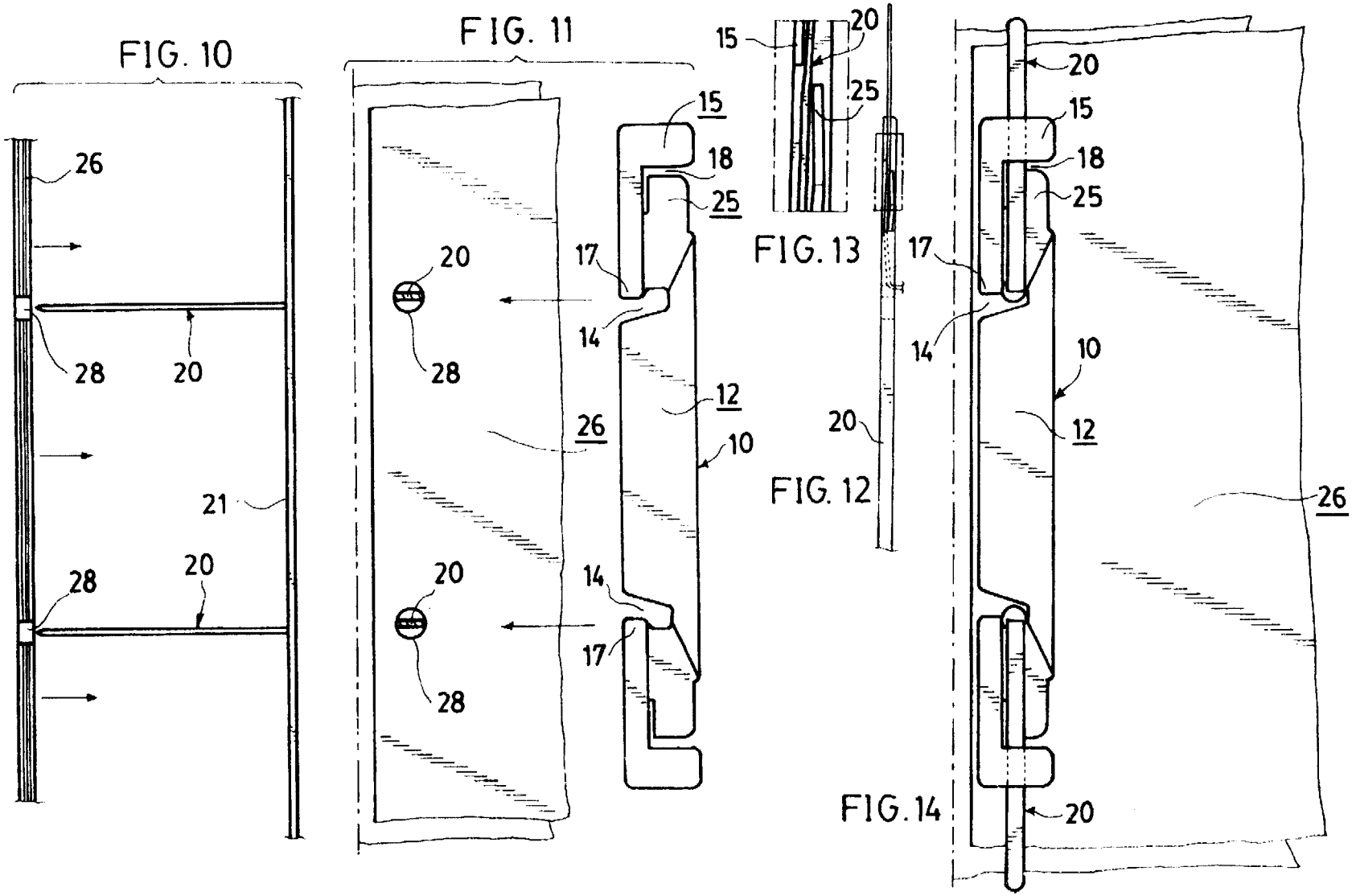
FIG. 10 is an assembly view showing how a bundle of paper is inserted on the strips for filing in a folder.
FIG. 11 illustrates in a plan view how the fastener according to the invention is pushed sideways in a horizontal plane onto the strips and into a locking position.
FIGS. 12 and 14 shows a partial side view and a plan view, respectively, of the fastener and how the strips are locked in place, thus filing and securing a bundle of papers.
FIG. 13 shows an enlargement of the framed in area of FIG. 12 with the strip locked in place.
Figure 19:
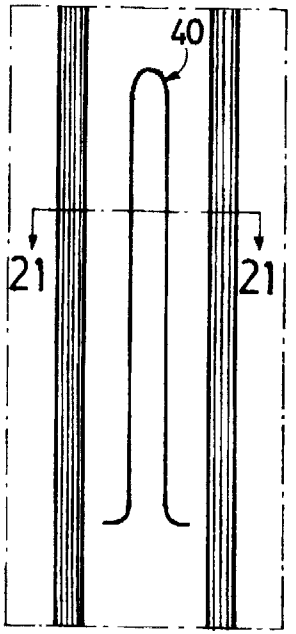

How the fastener 10 according to the invention is manipulated is illustrated further in the following figures. According to FIG. 10 strips 20 have been raised up from their base 21, ready to receive a bundle 20 of papers which by means of a punch have been provided with holes 28 spaced so that their center to center distance coincides with that of strips 20. The bundle 26 of papers is lowered down on the strips as shown by the arrows in FIG. 10, and then, as shown in the plan view in FIG. 11, the fastener 10 is pushed on from the side, which is also illustrated by arrows. After the strips have been bent and pushed underneath tongue 15 and above tongue 25, respectively, and clamped there, the final result will be as shown in FIGS. 12 and 14; fastener 10 is firmly set and locked against the paper bundle 26, as the strips are prevented from slipping in their longitudinal direction. As mentioned above, FIG. 13 shows the clamping area fastener/strip on a larger scale.

It is also noted, see FIG. 9 as well as FIG. 14, that the fastener 10 is fixed laterally in relation to strips 20, as these strips are prevented from sliding out by the "hooks" 17 formed at notches 14.

Figure 15:
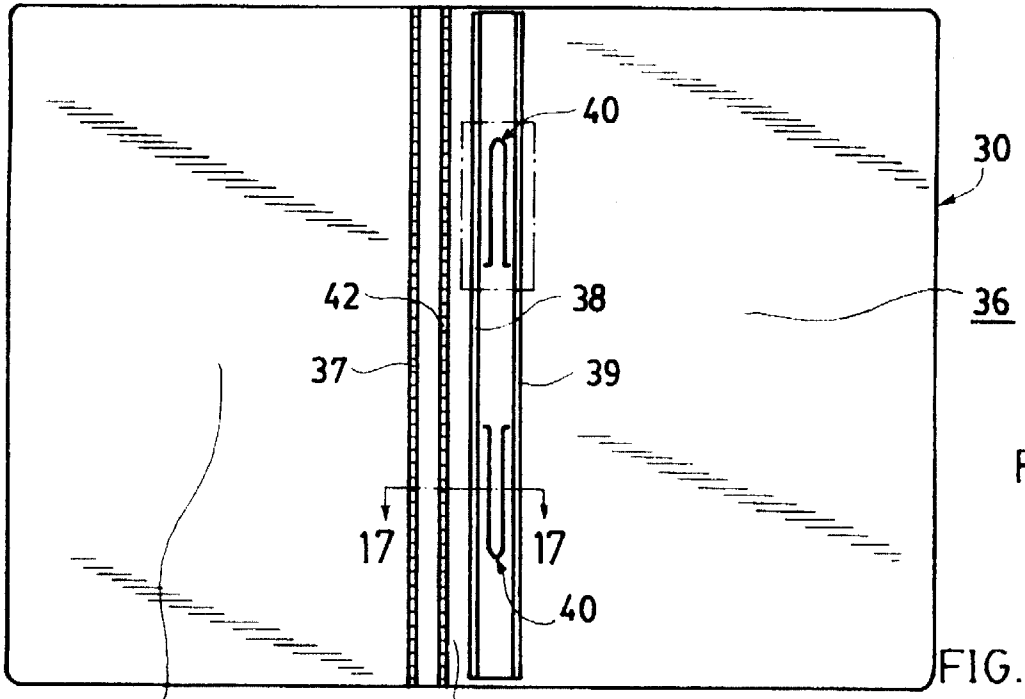
FIGS. 15 and 16 are plan views and end views, respectively, showing a conventional plastic folder but modified according to the invention.
Figure 16:
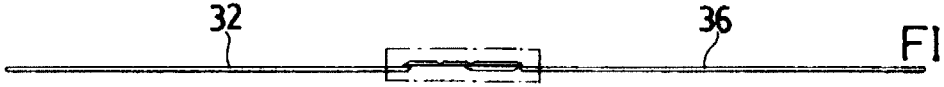
Figure 17:
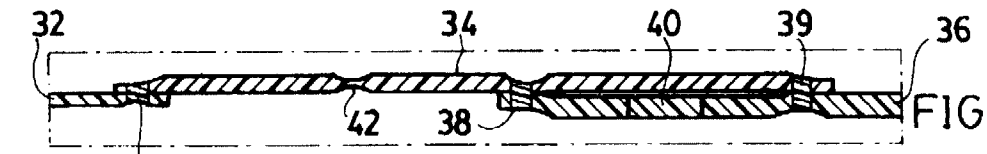
FIG. 17 shows, greatly enlarged, a cross section through the area framed in dotted line of FIG. 16, the section following line 17—17 as shown in FIG. 15.
Figure 18:
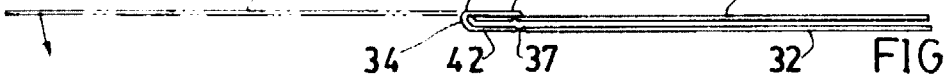
FIG. 18 is an end view showing the folder according to FIG. 16 in a folded position.

FIGS. 15 through 16 show a plastic folder 30 of conventional design which has been modified according to the invention and in such a way that the noted fastener 10 is capable of holding fast papers in the folder without, for this purpose, the folder being provided with the conventional metal strips; instead, the plastic material of the folder itself is used for creating strips having the same form and effect as the usual metal strips but with the added advantage of greatly reducing the cost of a folder-fastener assembly.

This specific folder 30, which is shown just as an example, consists of a (e.g. transparent) front sheet 32 and a rear sheet 36, which are joined by a back piece 34. In the usual way joining is carried out by means of longitudinal plastics welds 37, 38, 39, see the enlarged cross section in FIG. 17, the welding being carried out conventionally by means of an induction welder of known type. At 42 an longitudinal weld is embossed into the back piece 34 to form an extra pivot, so that the folder can be folded up about this pivot and the weld 38, as shown in FIG. 12

Plastic folders can be manufactured in various ways, but the one described above is quite conventional and commonly applied. According to the invention, however, a plastic folder and its manufacture is adjusted in a particular way: The rear sheet 36 of the plastic folder is thus welded to the connecting back piece 34 along two longitudinal welds 38 and 39. Between these welds the folder 30 has its greatest thickness, i. e. the sum of the thicknesses of back piece 34 and rear sheet 36. Before the usual webs of blank material fed to the welding machine are actually welded together and before they are cut in lengths corresponding to the height of the finished folder, the rear sheet 36 is subjected to a so called "steel edge punching". This means that the area of said rear sheet 36 which, after welding, will lie between joints 38 and 39 is punched or cut (no material removed) by means of a tool similar to a knife blade so as to form tongues or strips 40, as shown in FIG. 15 and on a larger scale in FIG. 19. These plastic strips 40 cut out can be pulled out and raised up from the surrounding material, see FIGS. 20 and 21, and will fulfill the same purpose as the conventional metal strips described earlier—provided they are allowed to work with the fastener according to the invention. The reason why such soft plastic strips can be used instead of the usual metal strips is due to the fact that the fastener 10 according to the invention will positively engage the strips; these are bent over the fastener which is pressed against the papers, then stretched somewhat and finally pushed in underneath the aforementioned tongues 15 and clamped fast, all as previously described, leaving a firmly held and locked system.

It has been described above how the plastic strips can be integrated in the folder by making them of the folder's own material but, needless to say, the strips can also be made as separate units to then be welded on site in the folder.

FIG. 22 shows part of a plastic strip 40' according to the above but designed in a particularly advantageous manner. To make the strip 40' according to FIG. 22 the blank material of the rear sheet 36 of folder 30 has passed (induction heated) embossing rolls which raise, in a manner well known in the art, transverse ribs 44 in the blank material within the area between the coming welds 38 and 39 where the strips are to be cut out and in such a manner that the ribs are formed on that surface of the rear sheet 36 which is facing the back piece 34. Strips 40' according to FIG. 22 have the advantage that they on one hand, will be considerably stiffened by ribs 44 preventing torsion and on the other hand will work in a more favourable manner with the lengthwise directed tongues 25 of fastener 10. The edges of these tongues can be made rather sharp in the injection moulding process, and when they engage the transverse ribs 44 of the a strip 40', see FIG. 24, a firm locking effect is obtained besides that caused by pure friction, thus preventing the strip from being pulled loose in its longitudinal direction (as already described, "hooks" 17 prevent loosening laterally). It should be pointed out, however, that tin certain cases one could be more interested in making strips 44' stiff in flexing rather than creating the locking effect just mentioned; if so, the said ribs are embossed into the strips not transversely, but lengthwise.

As a matter of course the invention is not limited to the ways of excercising the same which have been proposed here; the man of the art, in particular in the field of plastics production should be able to suggest many modifications within the scope of the invention as defined in the accompanying patent claims.

I claim:

1. A fastener for strips which are provided in files and folders and intended to be inserted through and hold fast papers stored in the folder, the fastener being adapted to engage the strips and prevent them from freely standing up and comprising:

a bar made of plastics or sheet metal and formed as a bar shape, at each end provided with a first incision or notch extending from one side of the bar and, closer to the end of the bar, a second incision or notch, narrower than the first notch and extending from the opposite side of the bar to form a cantilevered end portion or tongue substantially perpendicular to the longitudinal direction of the bar, a longitudinal groove extending from the inner end of said second notch in a direction away from the end of the bar to form a second cantilevered tongue, lengthwise of the bar, two said first notches, thus one at each end of the bar, being spaced a distance adjusted to the spacing of said strips so that the strips can be pushed laterally into said first notches, be bent down towards the ends of the bar and inserted into the second notches between the respective first and second tongues.

2. A fastener according to claim 1, characterized in that said first and second tongues at two ends of the fastener are located such in relation to the horizontal that a strip inserted between the tongues is exposed to a certain clamping or pinching action.

3. A fastener according to claim 1, characterized in that each said first notch has an area at an end of said first notch extended towards the end of the bar so that at each notch there is formed between this extended area and the edge of the bar a small portion which is directed towards the center of the bar and acts as a restraining hook on a strip inserted into the notch.

4. A fastener according to claim 1, in combination with a file or folder, which is formed with plastic material and is provided with holding strips of plastic material integrally formed on the folder or separately secured to the folder, which is manufactured with plastic sheet material for forming the front and rear sheets of the folder, characterized in that on the inside of the folder the plastic strips are rigidly secured to the folder in a position for cooperation with the papers and the like received in the folder and with the fastener in order to secure the papers and the like in the folder together with said fastener.

5. A fastener and folder as claimed in claim 4, characterized in that the folder comprises two plastic sheets joined either directly to each other by means of a back piece, it being seen to it that the material of the folder at the location of the intended strips has double thickness so that strips fulfilling the purpose of cooperating in said manner with papers and the like received in the folder and the fastener, can be punched or cut out from that portion of the material which is facing the interior of the folder.

6. A fastener and folder as claimed in claim 4, characterized in that the plastic strips on at least one side are provided with embossed transverse or longitudinal ribs for stiffening the strips and improving their locking cooperation with the fastener.

* * * * *